US011371404B2

(12) United States Patent
Anderson

(10) Patent No.: US 11,371,404 B2
(45) Date of Patent: Jun. 28, 2022

(54) ENGINE MUFFLER APPARATUS

(71) Applicant: Herbert Anderson, Charleston, SC (US)

(72) Inventor: Herbert Anderson, Charleston, SC (US)

( * ) Notice: Subject to any disclaimer, the term of this patent is extended or adjusted under 35 U.S.C. 154(b) by 352 days.

(21) Appl. No.: 16/539,334

(22) Filed: Aug. 13, 2019

(65) Prior Publication Data

US 2021/0047951 A1 Feb. 18, 2021

(51) Int. Cl.

| | |
|---|---|
| ***F01N 3/021*** | (2006.01) |
| ***F01N 1/10*** | (2006.01) |
| ***F01N 1/24*** | (2006.01) |

(52) U.S. Cl.

CPC ..... *F01N 3/021* (2013.01); *F01N 1/24* (2013.01); *F01N 2310/04* (2013.01); *F01N 2590/06* (2013.01)

(58) Field of Classification Search

CPC ..... F01N 3/021; F01N 3/0211; F01N 3/0212; F01N 3/022; F01N 3/02; F01N 3/00; F01N 1/24; F01N 1/08; F01N 1/081; F01N 1/082; F01N 1/10; F01N 1/00; F01N 2590/06; F01N 2590/00; F01N 2310/04; F01N 2310/02; F01N 2310/00

See application file for complete search history.

(56) References Cited

U.S. PATENT DOCUMENTS

| | | | | |
|---|---|---|---|---|
| 2,077,563 A * | 4/1937 | Thomas | F01N 3/0814 | 96/132 |
| 2,225,990 A * | 12/1940 | Henry | F25B 43/003 | 96/118 |
| 2,392,559 A * | 1/1946 | Varma | F01N 1/081 | 181/258 |
| 2,499,018 A | 2/1950 | Christiano | | |
| 2,748,883 A | 6/1956 | Ralph | | |
| 3,042,499 A * | 7/1962 | Williams, Sr. | F01N 3/26 | 422/183 |
| 3,521,429 A | 7/1970 | Leffler | | |
| 3,675,398 A * | 7/1972 | Giarrizzo | B01D 53/86 | 96/132 |
| 3,769,780 A * | 11/1973 | Kasten | B60R 21/26 | 96/387 |
| 3,798,769 A | 3/1974 | Bailey | | |

(Continued)

FOREIGN PATENT DOCUMENTS

| | | | |
|---|---|---|---|
| GB | 2030221 A * | 4/1980 | F01N 3/0217 |
| WO | WO-2007107078 A1 * | 9/2007 | F01N 13/011 |
| WO | WO-2011091624 A1 * | 8/2011 | F01N 3/038 |

*Primary Examiner* — Edgardo San Martin

(57) ABSTRACT

An engine muffler apparatus for reducing noise and pollution from small gas engines such as those on landscaping tools includes an outer housing having a central neck extension with a principal aperture extending through to an outer housing cavity. The neck extension is selectively engageable with an exhaust of a small gas engine. The outer housing cavity has a plurality of vent apertures. An intake extension tube and a medial tube are coupled to the outer housing cavity. The medial tube has a medial cavity. A first filtering medium is coupled within the medial cavity and filters pollutants passing therethrough. A second filtering medium is coupled within the outer housing cavity outside of the medial tube and dampens sound waves passing through the apparatus from the exhaust.

6 Claims, 4 Drawing Sheets

(56) References Cited

U.S. PATENT DOCUMENTS

| | | | | | |
|---|---|---|---|---|---|
| 3,889,776 | A * | 6/1975 | Postma | F01N 1/10 | 181/258 |
| 4,424,883 | A * | 1/1984 | Musiani | B25D 17/12 | 181/230 |
| 5,266,754 | A * | 11/1993 | Swift | F16L 55/02 | 181/230 |
| 5,470,364 | A * | 11/1995 | Adiletta | F01N 3/0217 | 55/484 |
| 5,611,409 | A | 3/1997 | Arseneau | | |
| 5,722,237 | A | 3/1998 | Iida | | |
| D394,236 | S | 5/1998 | Varlengiere | | |
| 5,969,299 | A | 10/1999 | Yamaguchi | | |
| 6,109,387 | A * | 8/2000 | Boretti | F01N 1/082 | 181/217 |
| 6,209,678 | B1 * | 4/2001 | Sterling | B25F 5/00 | 181/230 |
| 6,604,604 | B1 * | 8/2003 | Badeau | F01N 1/089 | 181/230 |
| 7,293,629 | B2 | 11/2007 | Nasuno | | |
| 7,523,605 | B2 | 4/2009 | Whitaker | | |
| 10,465,832 | B2 * | 11/2019 | Baltes | F01N 1/023 | |
| 2005/0051382 | A1 * | 3/2005 | Borgmeier | F16L 55/02745 | 181/252 |
| 2008/0099277 | A1 * | 5/2008 | Liu | B25F 5/00 | 181/230 |

* cited by examiner

ENGINE MUFFLER APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to mufflers and more particularly pertains to a new muffler for reducing noise and pollution from small gas engines such as those on landscaping tools.

BRIEF SUMMARY OF THE INVENTION

An embodiment of the disclosure meets the needs presented above by generally comprising an outer housing being cylindrical and having an outer top side, an outer bottom side, and an outer sidewall extending therebetween defining an outer housing cavity. The outer bottom side has a central neck extension. A principal aperture extends through the neck extension into the outer housing cavity. The neck extension is selectively engageable with an exhaust of a small gas engine. The outer top side has a plurality of vent apertures extending through to the outer housing cavity. An intake extension tube is coupled to the outer housing. The intake extension tube has an intake sidewall and an intake top side. The intake sidewall is coupled to the outer bottom side within the outer housing cavity around the principal aperture and an intake top side. The intake extension tube has a plurality of intake apertures extending through the intake sidewall and the intake top side. A medial tube is coupled to the outer housing. The medial tube has a medial sidewall and a medial top side defining a medial cavity surrounding the intake extension tube. The medial sidewall is coupled to the outer bottom side within the outer housing cavity around the intake extension tube. The medial tube has a plurality of medial apertures extending through the medial sidewall and the medial top side. A first filtering medium is coupled within the medial cavity and filters pollutants passing therethrough. A second filtering medium is coupled within the outer housing cavity outside of the medial tube and dampens sound waves passing through the apparatus from the exhaust.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
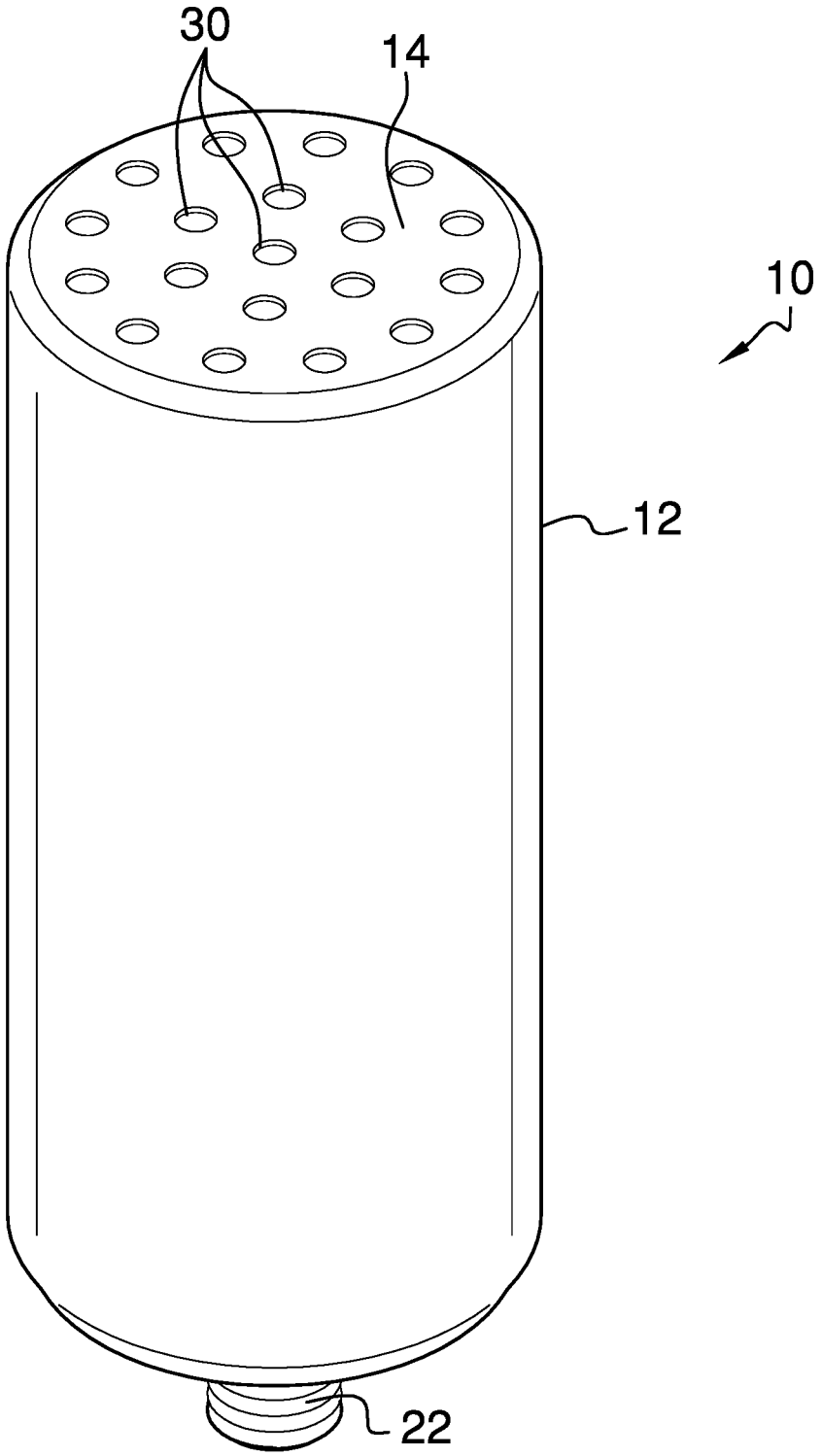
FIG. 1 is an isometric view of an engine muffler apparatus according to an embodiment of the disclosure.
Figure 2:
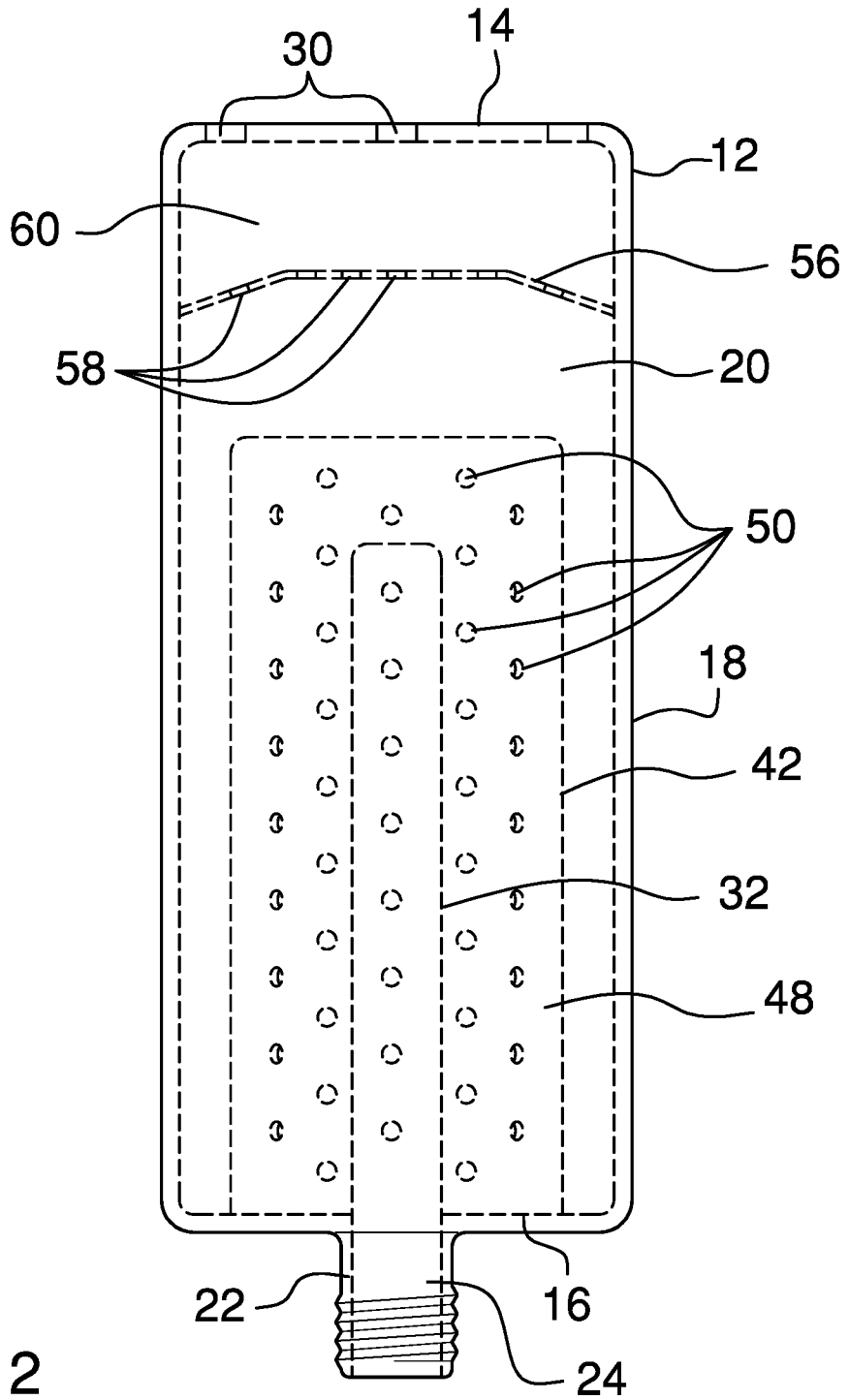
FIG. 2 is a front elevation view of an embodiment of the disclosure.
Figure 3:
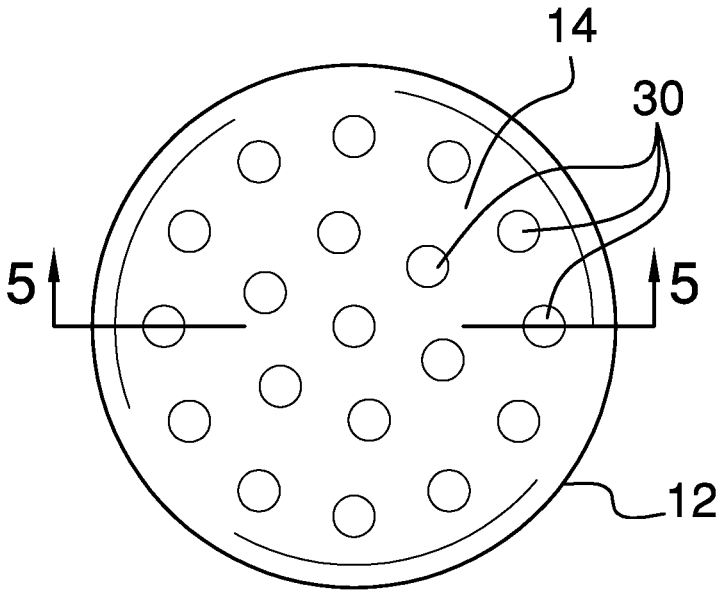
FIG. 3 is top plan view of an embodiment of the disclosure.
Figure 4:
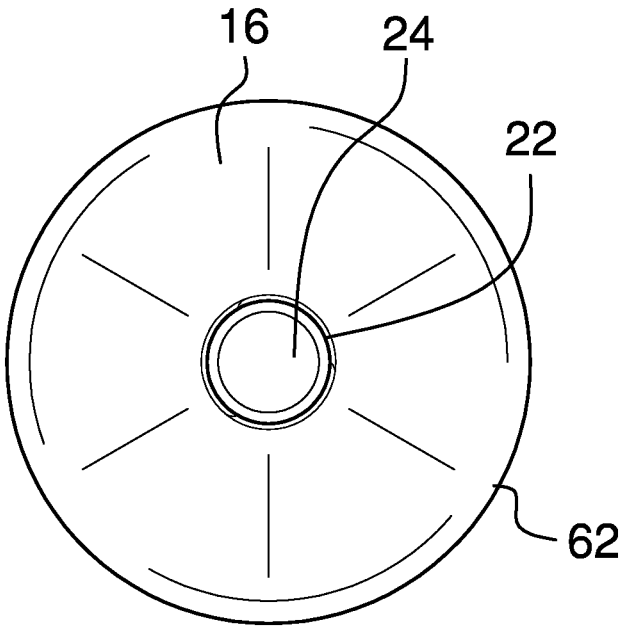
FIG. 4 is a bottom plan view of an embodiment of the disclosure.
Figure 5:
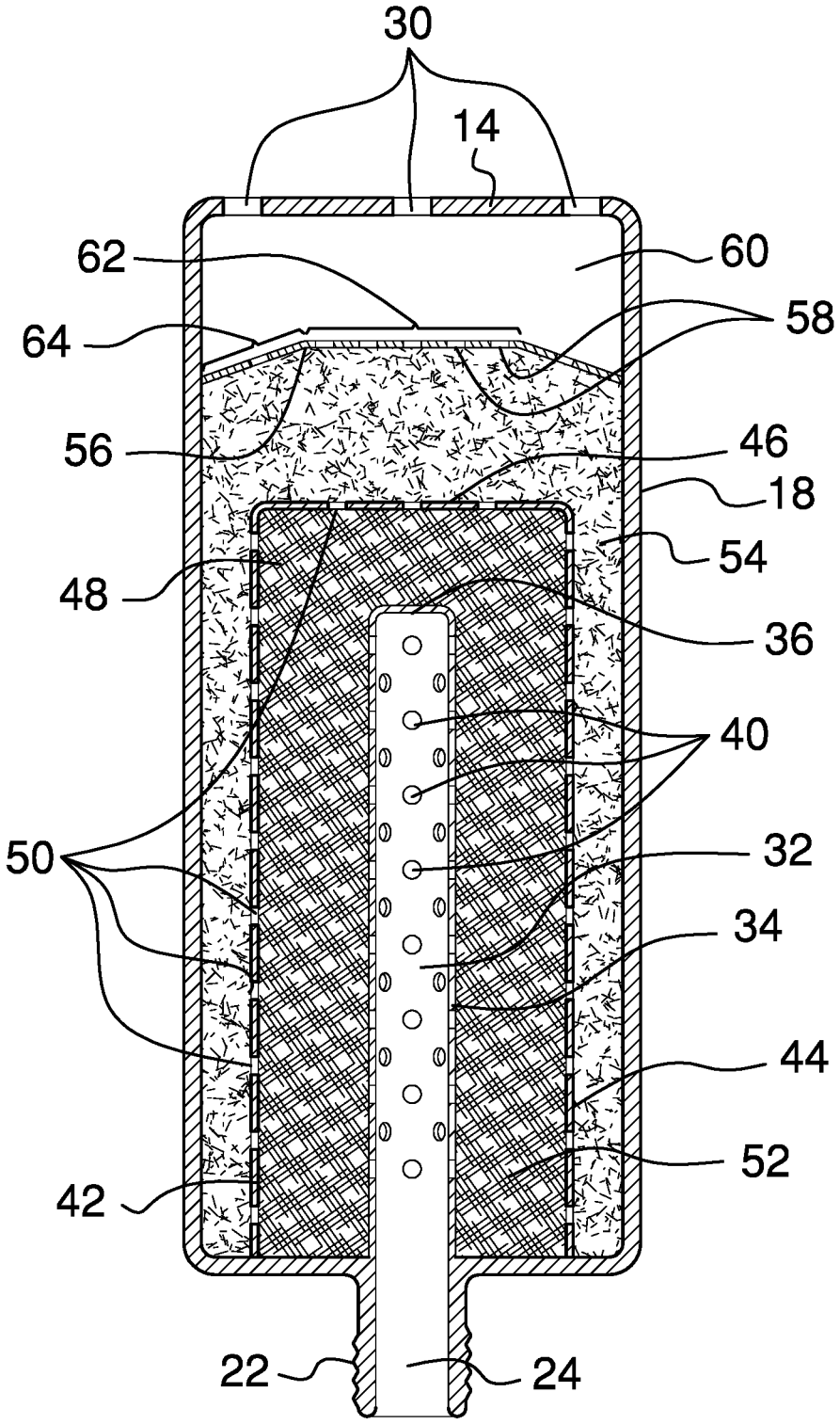
FIG. 5 is a cross-sectional view along line 5-5 of FIG. 3 of an embodiment of the disclosure.

With reference now to the drawings, and in particular to FIGS. 1 through 5 thereof, a new muffler embodying the principles and concepts of an embodiment of the disclosure and generally designated by the reference numeral 10 will be described.

As best illustrated in FIGS. 1 through 5, the engine muffler apparatus 10 generally comprises an outer housing 12 being cylindrical and having an outer top side 14, an outer bottom side 16, and an outer sidewall 18 extending therebetween defining an outer housing cavity 20. The outer bottom side 16 has a central neck extension 22. A principal aperture 24 extends through the neck extension 22 into the outer housing cavity 20. The neck extension 22 may be threaded and is selectively engageable with an exhaust of a small gas engine. The outer top side 14 has a plurality of vent apertures 30 extending through to the outer housing cavity 20. An intake extension tube 32 is coupled to the outer housing 12. The intake extension tube 32 has an intake sidewall 34 and an intake top side 36. The intake sidewall 34 is coupled to the outer bottom side 16 within the outer housing cavity 20 around the principal aperture 24 and the intake top side 36. The intake extension tube 32 has a plurality of intake apertures 40 extending through the intake sidewall 34 and the intake top side 36. A medial tube 42 is coupled to the outer housing 12. The medial tube 42 has a medial sidewall 44 and a medial top side 46 defining a medial cavity 48 surrounding the intake extension tube 32. The medial sidewall 44 is coupled to the outer bottom side 16 within the outer housing cavity 20 around the intake extension tube 32. The medial tube 42 has a plurality of medial apertures 50 extending through the medial sidewall 44 and the medial top side 46. A first filtering medium 52 is coupled to the medial tube 42. The first filtering medium 52 is charcoal. The first filtering medium 52 is coupled within the medial cavity 48 and filters pollutants passing therethrough. A second filtering medium 54 is coupled to the outer housing 12. The second filtering medium 54 is heat treated steel wool. The second filtering medium 54 is coupled within the outer housing cavity 20 outside of the medial tube 42 and dampens sound waves passing through the apparatus 10 from the exhaust. A baffle 56 is coupled to the outer sidewall 18 within the outer housing cavity 20 and contains the second filter medium 54. The baffle 56 has a plurality of baffle apertures 58 extending therethrough. The baffle 56 defines an empty portion 60 of the outer housing cavity 20 between the baffle 56 and the outer top side 14. The baffle 56 has a central portion 62 and a perimeter portion 64. The central portion 62 lies in a plane coplanar with the outer top side 14. The perimeter portion 64 extends at a downward angle to the outer sidewall 18.

In use, the apparatus 10 is engaged with the exhaust of a small gas engine, such as a weedwhacker, lawnmower, or other landscaping tool. The first filtering medium 52 filters pollutants and the second filtering medium 54 dampens the sound waves passing through the apparatus 10 to minimize noise from the engine.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An engine muffler apparatus comprising:

an outer housing, the outer housing being cylindrical and having an outer top side, an outer bottom side, and an outer sidewall extending therebetween defining an outer housing cavity, the outer bottom side having a central neck extension, a principal aperture extending through the neck extension into the outer housing cavity, the neck extension being selectively engageable with an exhaust of a small gas engine, the outer top side having a plurality of vent apertures extending through to the outer housing cavity;

an intake extension tube coupled to the outer housing, the intake extension tube having an intake sidewall and an intake top side, the intake sidewall being coupled to the outer bottom side within the outer housing cavity around the principal aperture and an intake top side, the air intake top side being spaced from the outer top side of the outer housing, the intake extension tube having a plurality of intake apertures extending through the intake sidewall and the intake top side;

a medial tube coupled to the outer housing, the medial tube having a medial sidewall and a medial top side defining a medial cavity surrounding the intake extension tube, the medial top side being parallel to the air intake top side and the outer top side of the outer housing, the medial sidewall being coupled to the outer bottom side within the outer housing cavity around the intake extension tube, the medial tube having a plurality of medial apertures extending through the medial sidewall and the medial top side;

a first filtering medium coupled to the medial tube, the first filtering medium being coupled within the medial cavity and filtering pollutants passing therethrough; and a second filtering medium coupled to the outer housing, the second filtering medium being coupled within the outer housing cavity outside of the medial tube and dampening sound waves passing through the apparatus from the exhaust.

2. The engine muffler apparatus of claim 1 further comprising a baffle coupled to the outer housing, the baffle being coupled to the outer sidewall within the outer housing cavity and containing the second filter medium, the baffle having a plurality of baffle apertures extending therethrough, the baffle defining an empty portion of the outer housing cavity between the baffle and the outer top side.

3. The engine muffler apparatus of claim 1 further comprising the first filtering medium being charcoal.

4. The engine muffler apparatus of claim 1 further comprising the second filtering medium being heat treated steel wool.

5. The engine muffler apparatus of claim 1 further comprising the baffle having a central portion and a perimeter portion, the central portion lying in a plane parallel with the outer top side, the perimeter portion extending at a downward angle to the outer sidewall.

6. An engine muffler apparatus comprising:

an outer housing, the outer housing being cylindrical and having an outer top side, an outer bottom side, and an outer sidewall extending therebetween defining an outer housing cavity, the outer bottom side having a central neck extension, a principal aperture extending through the neck extension into the outer housing cavity, the neck extension being selectively engageable with an exhaust of a small gas engine, the outer top side having a plurality of vent apertures extending through to the outer housing cavity;

an intake extension tube coupled to the outer housing, the intake extension tube having an intake sidewall and an intake top side, the air intake top side being spaced from the outer top side of the outer housing, the intake sidewall being coupled to the outer bottom side within the outer housing cavity around the principal aperture and the intake top side, the intake extension tube having a plurality of intake apertures extending through the intake sidewall and the intake top side;

a medial tube coupled to the outer housing, the medial tube having a medial sidewall and a medial top side defining a medial cavity surrounding the intake extension tube, the medial top side being parallel to the air intake top side and the outer top side of the outer housing, the medial sidewall being coupled to the outer bottom side within the outer housing cavity around the intake extension tube, the medial tube having a plurality of medial apertures extending through the medial sidewall and the medial top side;

a first filtering medium coupled to the medial tube, the first filtering medium being charcoal, the first filtering medium being coupled within the medial cavity and filtering pollutants passing therethrough;

a second filtering medium coupled to the outer housing, the second filtering medium being heat treated steel wool, the second filtering medium being coupled within the outer housing cavity outside of the medial tube and dampening sound waves passing through the apparatus from the exhaust; and a baffle coupled to the outer housing, the baffle being coupled to the outer sidewall within the outer housing cavity and containing the second filter medium, the baffle having a plurality of baffle apertures extending therethrough, the baffle defining an empty portion of the outer housing cavity between the baffle and the outer top side, the baffle having a central portion and a perimeter portion, the central portion lying in a plane parallel with the outer top side, the perimeter portion extending at a downward angle to the outer sidewall.

* * * * *